United States Patent [19]

Ford

[11] 4,028,213

[45] June 7, 1977

[54] VARIABLE GAP ANODE ASSEMBLY FOR ELECTROLYTIC CELLS

[75] Inventor: James M. Ford, Cleveland, Tenn.

[73] Assignee: Olin Corporation, New Haven, Conn.

[22] Filed: Feb. 9, 1976

[21] Appl. No.: 656,166

[52] U.S. Cl. ..... 204/286; 204/225; 204/266

[51] Int. Cl.[2] ..... C25B 11/00; C25C 7/00

[58] Field of Search ..... 204/252, 266, 260, 212, 204/225, 280–284, 286

[56] References Cited

UNITED STATES PATENTS

| | | | |
|---|---|---|---|
| 2,545,294 | 3/1951 | Messinger et al. | 204/212 |
| 3,873,437 | 3/1975 | Pulver | 204/280 X |
| 3,941,676 | 3/1976 | Macken | 204/252 X |

*Primary Examiner*—John H. Mack
*Assistant Examiner*—D. R. Valentine
*Attorney, Agent, or Firm*—James B. Haglind; Donald F. Clements; Thomas P. O'Day

[57] ABSTRACT

An electrolytic cell of the type having a plurality of anodes and at least one foraminous cathode. The cell includes an anode mounting plate to which the anodes are connected. The anodes have associated therewith a mounting post which is attached to the anode mounting plate of the cell by attaching means which can be used to vary the spacing between the anodes for reception of the cathodes. The attaching means includes a crank member which, upon rotation thereof, moves the mounting posts laterally with respect to the anode mounting plate.

10 Claims, 3 Drawing Figures

VARIABLE GAP ANODE ASSEMBLY FOR ELECTROLYTIC CELLS

BACKGROUND OF THE INVENTION

This invention generally relates to an electrolytic cell of the type which includes a cell enclosure, a plurality of anodes, a foraminous cathode extending between adjacent anodes, and a diaphragm or membrane in the anode-cathode gap. More particularly, this invention relates to such electrolytic cells having an improved anode mounting structure for attaching anodes to an anode mounting plate so the anodes can be moved laterally with respect to the anode mounting plate to adjust the anode-cathode gap.

In a Hooker-type electrolytic cell, for example, the anodes are attached to an anode mounting plate which is usually the base of the cell. Foraminous iron or steel cathodes coated with a diaphragm are suspended from the sides of the cell body and extend between adjacent anodes.

In cases where the anodes are fabricated from graphite, the anodes are secured with lead and an asphaltic sealer in the cell base. Recently, the graphite anodes have been replaced by metallic anodes having a suitable conducting coating on the outer surface of the anode.

U.S. Pat. No. 3,591,483, issued July 6, 1971, to Loftfield, et al, describes one method of attaching metallic anodes to the cell base. According to this patent, the cell base is of conducting material, the interior of which is covered with an electrically non-conductive sheet. The anodes include an anode riser having a flange in the lower portion thereof and a portion extending from the flange through an aperture in the cell base. The anode posts are threaded and secured to the cell base with threaded nuts.

With the anodes mounted in the manner described above, they cannot be adjusted laterally with respect to the base plate to vary the anode-cathode gap. Substantial space is required between the anode and the cathode during assembly of the cell to prevent scraping between them due to misalignment or dimensional deficiencies. Such scraping is undesirable because it may result in the breaking of the diaphragm which would cause operational problems due to the mixing of the anode and cathodic products. In the case where the diaphragm is asbestos, scraping might also cause asbestos particles to break loose from the diaphragm, which is also undesirable. Therefore, the anode-cathode gap must be wide enough to permit assembly of the cell. However, it is desirable to keep the anode-cathode gap small since the resistance of the electrolyte in the gap to the passage of electrolyzing current raises significantly the operating voltage of the cells. Thus, the wider the gap, the greater the energy consumption and the more costly the cell is to operate. The space required to permit proper assembly of the components of the cell is usually greater than the optimum anode-cathode gap which results in the most efficient operation of the cell.

In order to overcome the above problem, it has been proposed previously in U.S. Pat. No. 3,796,648, issued Mar. 12, 1974, to Conner, Jr., et al, to attach the anode post to the base plate by having a threaded stud portion thereof protrude through an enlarged hole in the base plate. When the nuts are untightened, the anodes can be moved laterally with respect to the base plate either manually or by insertion of the cathodes between them with the use of spacing elements.

A similar approach is disclosed in U.S. Pat. No. 3,803,016, issued to Conner, Jr., on Apr. 9, 1974. According to the disclosure of this patent, each of the anodes includes adjustable anode sections provided with independent anode mounts for each section. The anode mounts extend through an enlarged aperture or slot in the base plate and are secured thereto by means of a threaded nut. When the nut is untightened, each anode section can be moved to vary the width of the anodes so that the space between adjacent anodes is enlarged to permit installation of the cathodes or minimized to narrow the distance between the anode and the diaphragm surface on the cathode.

It is to be noted that according to the arrangements discussed above, no mechanism is provided which will positively move the anodes. According to the described arrangements after the nut is loosened, the anodes must be either moved manually or by cathode as it is inserted between the anodes.

Accordingly, it is an object of this invention to provide an improved anode mounting structure for attaching anodes of an electrolytic cell to an anode mounting plate wherein the anodes can be adjusted to vary the anode-cathode gap.

It is a further object of this invention to provide an improved adjustable anode mounting structure for use in connection with electrolytic cells wherein the mounting structure can be used to positively move the anodes.

According to the broad aspects of the invention, attaching means are provided for attaching the mounting posts of an anode of an electrolytic cell to an anode mounting plate. The attaching means includes a portion extending through the anode mounting plate and adapted for rotation therein whereby upon rotation thereof lateral movement with respect to the base plate is imparted to the anode.

The attaching means preferably includes a crank having one end extending through the anode mounting plate and the other end mounted in the mounting post. Rotation of the end of the crank extending through the plate member will result in movement of the anode laterally of the plate member.

DESCRIPTION OF THE DRAWINGS

The present invention will be more readily understood by reference to the following detailed description and to the accompanying drawings in which.

DETAILED DESCRIPTION

Figure 1:
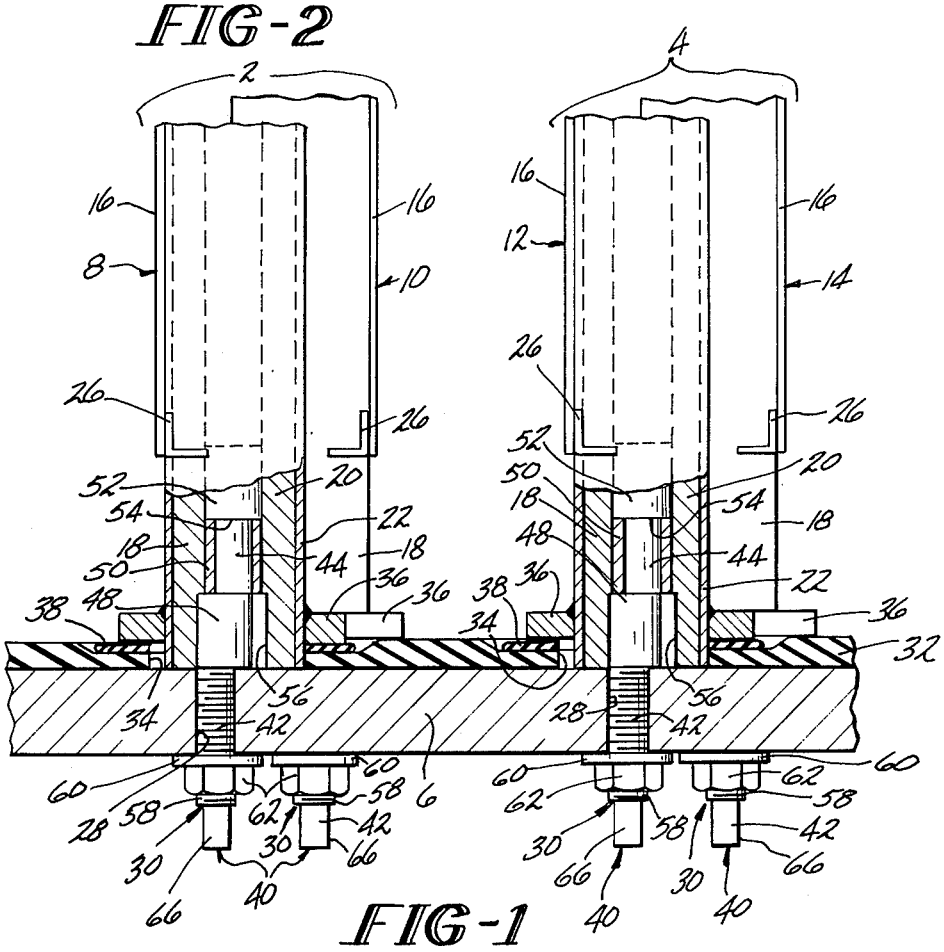
FIG. 1 is a simplified transverse view, partially in section through an electrolytic cell showing the improved anode mounting structure of the present invention with the cell can and cathodes removed for clarification.

Referring to the drawings and particularly to FIG. 1, there is shown two anodes 2 and 4 attached to an anode mounting plate 6. The anode 2 comprises two anode sections 8 and 10 which are capable of lateral movement with respect to the mounting plate 6 relative to each other. The anode 4 comprises two anode sections 12 and 14 which are also capable of lateral movement with respect to the mounting plate 6 relative to each other. Each anode section 8, 10, 12, and 14 includes a metal surface 16 and an anode mounting post 18 connected to the metal surface 16 by any suitable technique such as welding or the like. Each anode mounting post 18 is attached to the anode mounting plate 6 and held in position such that the anode sections 8, 10, 12, and 14 extend generally perpendicular to the base plate 6.

Each anode mounting post 18 may be in the form of a generally tubular, elongated member. The post 18 may be fabricated from a core 20 clad with an exterior sheet 22. Usually core 20 is constructed of aluminum, copper, iron, steel and the like and is clad with an exterior sheet 22 of a corrosion resistant metal such as titanium. Although titanium is generally utilized for the sheet 22, other suitable metals include tantalum, columbium, and zirconium.

Each metal surface 16 may be a solid sheet or mesh comprised of a titanium base coated with at least one metal and/or metal oxide of a platinum group metal such as platinum or ruthenium oxide. However, other suitable metals, metal oxides, and mixtures thereof useful as these metal surfaces are well known in the art. Each metal surface 16 may be stiffened through the use of upper and lower elongated angle brackets 24 and 26 which extend substantially the entire width of the anode section. The brackets 24 and 26 may be fabricated from titanium or other suitable material. Each of the metal surfaces 16 are attached to a mounting post 18 by any suitable electrically conductive attaching means such as welding.

The anode mounting plate 6 is preferably the base of the electrolytic cell. As such it may be constructed from an electrically conductive metal such as aluminum, copper, iron, steel, alloys of at least one of these metals, and the like. In such a case, the anode mounting plate 6 may serve as the current conductor to the anodes 2 and 4.

The anode mounting plate 6 is provided with a plurality of holes 28 through which anode attaching means 30 for the anode mounting posts 14 extend. The anode mounting plate 6 is preferably covered with a lining 32 which isolates the base from the anolyte and helps seal the holes 28 in the base plate 6. The lining preferably should be non-metallic, non-conductive, and corrosion resistant. Some suitable materials are hard rubber, polyethylene, chlorinated polyvinyl chloride, neoprene, polyproplyene, acrylonitrile-butadiene-styrene polymers (ABS), with or without fiber glass reinforcement fillers, polymerized fluorinated ethylene, polyester, mixtures thereof and the like. Hard rubber is preferably used as the lining 32. The lining 32 is provided with holes 34 coaxial with each of the holes 28 in the mounting plate 6 and of such size that each of the posts 18 can move freely therein.

Each anode mounting post 18 is provided with a washer 36 which is welded or otherwise suitably attached thereto to provide a permanent connection therebetween. A relatively soft rubber gasket 38, having an aperture 39 therein of a diameter substantially equal to that of a hole 34 in the lining 32, surrounds each post 18 and is interposed between the washer 36 and the hard rubber lining 32. The bottom surface of each washer 36 is spaced from the end of its anode mounting post 18 a suitable distance so that when the post 18 is pulled down against the base plate 6, the washer 36 will engage the gasket 38 so that the lining 32 and the gasket 38 are compressed into tight sealing relationship to seal the holes 28 in the mounting plate 6.

Each anode attaching means 30 includes a crank member 40 having a crank shaft portion 42 extending through an associated hole 28 in the anode mounting plate 6. The other end of the crank member 40 includes a shaft portion 44 having an axis parallel to, but offset with respect to the axis of the crank shaft portion 42 and which is mounted in the bore 46 of a post 18. The axis of portion 44 is coincident with the axis of the bore 46. Portions 42 and 44 may be interconnected by any suitable means depending upon how the crank member 40 is fabricated. As shown in the drawings, portions 42 and 44 are interconnected by an intermediate cylindrical portion 48 which has one edge coincident with the outer edge of the crank shaft portion 42 and its opposite edge coincident with the outer edge of portion 44. Other arrangements may be used as long as the axis of the crank shaft portion 42 is offset with respect to the axis of portion 44.

Surrounding portion 44 of the crank member 40 is a split retaining ring 50 preferably fabricated from copper or other suitable electrically conductive material. The ring 50 acts as a bearing surface for portion 44 and also as the axial connection between the post 18 and the crank member 40. The crank member 40 terminates in an enlarged head portion 52 having a diameter substantially equal to the diameter of the bore 46 of the anode mounting post 18 and having a shoulder 54 for axially engaging the end of ring 50.

The upper end of the crank member 40 is inserted into the bore 46 of the anode mounting post 18 with the split retaining ring 50 being press-fitted within the bore 46 to provide tight connection therewith. Other methods of assembling the ring 50 within the bore 46 of the post 18 may be used so long as a tight connection is obtained between the ring 50 and post 18 in at least the axial direction. The lower end of each post 18 is provided with a counter-bore 56 to receive the intermediate portion 48 of the crank member 40.

After a crank member 40 has been inserted into the lower end of an anode mounting post 18, the crank shaft portion 42 may be inserted through a gasket 38, a hole 34 in the lining 32 and one of the holes 28 in the mounting plate 6. Each crank shaft portion 42 may include a threaded section 58 for the reception of a washer 60 and a threaded nut member 62. When the nut member 62 is tightened, the shoulder 54 of the head portion 52 of the crank member 40 will be pulled down against the split retaining ring 50. Because of the fact that the ring 50 is axially secured in the post 18, tightening of the nut member 62 will also draw the end of the post 18 tight against the mounting plate 6 so that a good electrical connection will be maintained between them. In addition, when the nut member 62 is tightened against the washer 60 and base plate 6, the washer member 36 attached to the post 18 will be drawn against the gasket 38 which in turn is drawn against lining 32 to provide good sealing relationship therebetween.

With the crank members 40 associated with anode sections 8 and 12 positioned as shown in FIG. 1, it may be seen that the anode sections 8 and 12 are positioned in their righthand-most position as viewed in that figure. As shown, the axis of portion 44 is offset to the right with respect to the axis of crank shaft portion 42.

Each of the crank members 40 which is associated with anode sections 10 and 14 have the axis of its portion 44 offset to the left with respect to the axis of the crank shaft portion 42 so that the anode sections 10 and 14 are positioned in their lefthand-most position as viewed in FIG. 1.

In this position, anode sections 8 and 10 of anode 2 will be positioned closest together as will the anode sections 12 and 14 of anode 4. The space or gap between facing anode sections 10 and 12 of adjacent anodes will be the greatest. With the anodes arranged in this manner, cathodes 64 (see FIG. 2) may be positioned between facing anode sections. As the space between the opposing anode sections of adjacent anodes is relatively large, there is less likelihood of scraping or damaging the cathode or its attached diaphragm during assembly.

When the cathodes 64 are in place, the anodes 2 and 4 may be adjusted so that the gap between an anode section and its associated cathode is brought to the minimal practical distance. This is accomplished by loosening the nut members 62. With a nut member 60 loosened, each crank shaft portion 42 may be rotated about its axis. To facilitate this, the free end of the crank shaft portion 42 may be suitably machined to provide a grasping portion 66 having a square cross-section for facilitating the grasping thereof by a wrench or other suitable torque-applying implement.

Upon rotation of the crank shaft portion 42, the axis of portion 42 which is coincident with the axis of the anode mounting post 18 will revolve about the axis of portion 42 until it is positioned on the opposite side thereof. This movement of portion 42 carries with it the anode mounting post 18 and its associated anode section.

Figure 2:
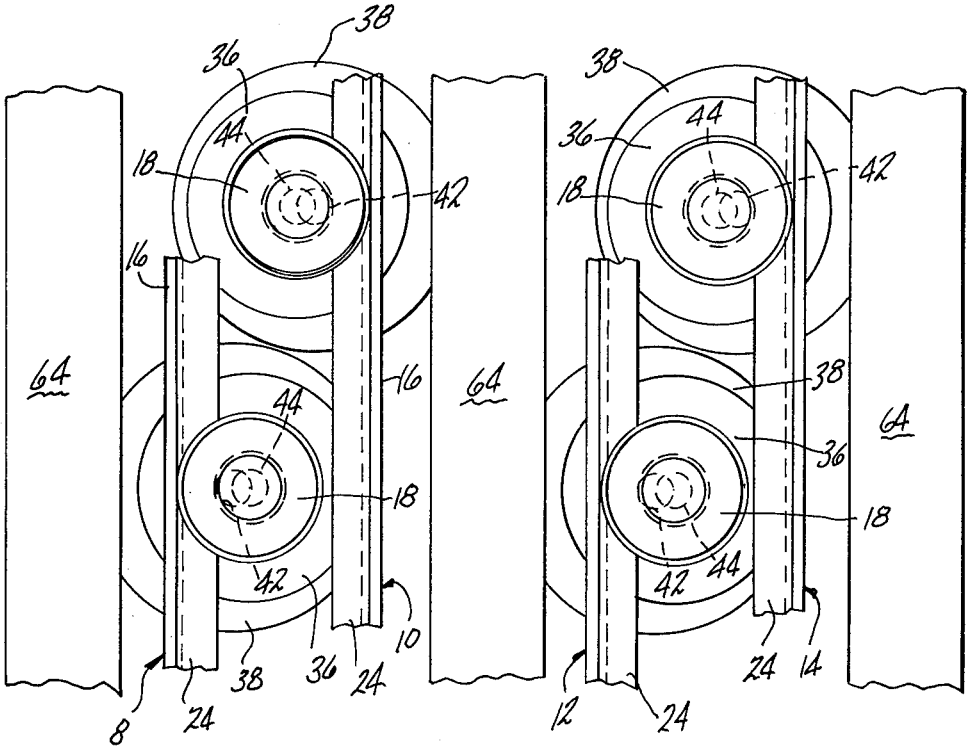
FIG. 2 is a simplified plan view of the structure shown in FIG. 1 and showing the cathode in place.
Figure 3:
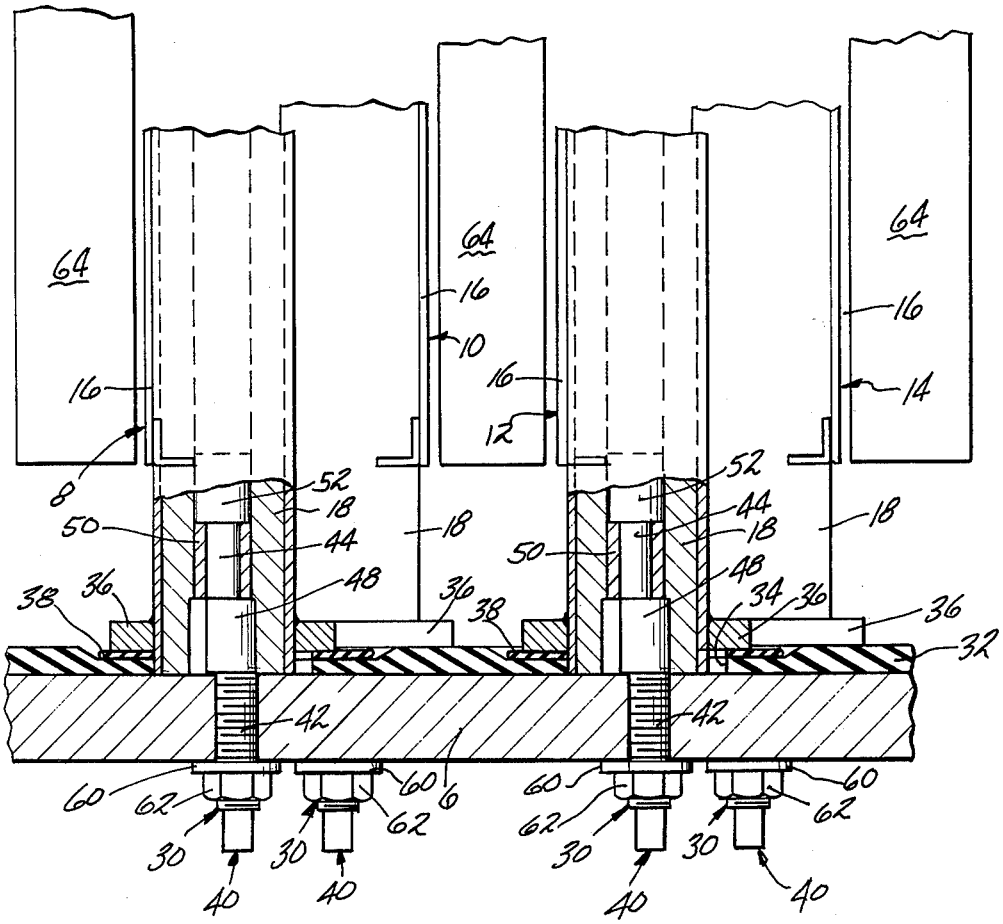
FIG. 3 is a view similar to FIG. 1, but showing the cathode in place and the anodes adjusted so that the anode-cathode gap is the smallest.

Referring to FIGS. 1 and 2, rotation of the crank shaft portion 42 of the crank members 40 associated with anode sections 8 and 12 from the position shown in FIG. 1, will move the anode sections 8 and 12 to the left moving them closer to their associated cathode. Rotation of the crank shaft portion 42 of the crank members 40 associated with anode sections 10 and 14, from the position shown in FIG. 1, will move the anode sections 10 and 14 to the right as viewed in FIGS. 1 and 2 and narrow the gap between them and their associated cathodes. Maximum displacement of the anode posts takes place upon 180° rotation of the crank shaft portion 34 from its position shown in FIG. 1. FIG. 3 shows the anode after maximum displacement has taken place.

When the anode sections of the electrolytic cell are moved toward their associated cathodes a suitable distance to provide the proper anode-cathode gap, the nut members 54 may be re-tightened. The anode sections will then be held in proper spaced relationship with respect to the cathodes.

The maximum amount of lateral movement of any of the anode sections is twice the distance between the axis of the crank shaft portion 42 and portion 44 of the crank. The crank shaft may be constructed to provide any reasonable amount of movement limited by practical design considerations and construction of the electrolytic cell.

Although the above described preferred embodiment contemplates the use of an anode having two anode sections each of which can be moved relative to each other, other anode arrangements may also be used. For example, in some instances it may be desirable that only one anode section be movable relative to the base plate and the other attached in an unmovable manner. In addition, the above described attaching means 30 may also be used in connection with anodes having both metal surfaces attached to the same posts. In any given application, it is to be understood that a given anode or anode section may, because of its length, have associated with it more than one anode mounting post 18 each of which could have a corresponding attaching means 30.

The anode attaching means of the present invention may be used in electrolytic cells of the type having at least one anode and at least one foraminous cathode. Such cells may be of many different types and designs and may or may not include a diaphragm or membrane in the anode-cathode gap. For example, the present invention may be used in a cell used for the electrolysis of alkali metal chloride solutions, including not only sodium chloride but also potassium chloride, lithium chloride, rubidium chloride and cesium chloride. In the electrolysis using a diaphragm covering the foraminous cathode, caustic, chlorine and hydrogen are produced. Using certain modifications and changes in the method of reacting, such as by removing the diaphragm or further reacting the produced caustic and chlorine, alkali metal chlorates can also be produced. In some instances, when used for the production of alkali metal chlorates, solutions containing both alkali metal chlorate and alkali metal chloride may be recirculated to the cell for further electrolysis. In addition, the invention may be utilized in a cell for the electrolysis of hydrogen chloride by electrolyzing hydrogen chloride in combination with an alkali metal chloride. Thus, the present invention is highly useful in these and many other aqueous electrolytic processes.

By virtue of the above described anode attaching means, it is possible to mount the anodes of an electrolytic cell on an anode mounting plate in a manner which maximizes the distance between facing anode surfaces of adjacent anodes so that the cathodes can be easily inserted into place between the anodes. The anodes can be easily adjusted to decrease the gap between the anode surface and its respective cathode by imparting rotation to the connecting assembly. This rotation results in positive movement being imparted to the anodes.

What is claimed is:

1. A multiple anode assembly for an electrolytic cell of the type including an anode mounting plate, at least one anode, and at least one foraminous cathode, said assembly comprising:

a. at least one mounting means for each of said anodes, said mounting means is a post, one end of said post being held in electrical contact with said anode mounting plate; and b. attaching means for attaching at least some of said mounting means to said anode mounting plate so said anodes are maintained in a substantially perpendicular relationship thereto, said attaching means including a portion extending through said anode mounting plate and adapted for rotation therein for imparting lateral movement to said mounting means with respect to said anode mounting plate.

2. The assembly of claim 1 wherein said attaching means includes a crank member having a first portion mounted for rotation about its axis in said anode mounting plate and a second portion mounted in said mounting means, the axis of said second portion being parallel to and offset with respect to the axis of said first portion.

3. The assembly of claim 1 wherein said anode mounting plate is the cell base plate and is an electrical conductor and said attaching means includes means for holding said mounting means in electrical contact with said base plate.

4. A multiple anode assembly for an electrolytic cell of the type including an anode mounting plate, at least one foraminous cathode, and a plurality of substantially parallel anodes, said anodes having at least two anode sections, at least one of which is movable with respect to the other, said assembly comprising:

a. at least one mounting means for each anode section, said mounting means is a post, one end of said post being held in electrical contact with said anode mounting plate; and b. attaching means for attaching at least one of said mounting means of at least one of the anode sections to said anode mounting plate, said attaching means including a portion extending through said mounting plate and adapted for rotation therein whereby upon rotation thereof lateral movement with respect to said mounting plate is imparted to said anode section.

5. A multiple anode assembly for an electrolytic cell of the type including an anode mounting plate, at least one foraminous cathode, a plurality of substantially parallel anodes, said anodes having adjustable anode sections, said assembly comprising:

a. at least one mounting means for each anode section, said mounting means is a post, one end of said post being held in electrical contact with said anode mounting plate; and b. attaching means for attaching each said mounting means to said base plate, said attaching means including a portion extending through an opening in said mounting plate and adapted for rotation therein whereby upon rotation thereof lateral movement with respect to said mounting plate is imparted to said anode section.

6. The assembly of claim 5 wherein said attaching means includes a crank member having a first portion mounted for rotation about its axis in said anode mounting plate and a second portion mounted in said mounting means, the axis of said second portion being parallel to and offset with respect to the axis of said first portion.

7. The assembly of claim 6 wherein said anode mounting plate is electrically conductive and said attaching means further includes means for holding said mounting means in electrical contact with said mounting plate.

8. The assembly of claim 7 wherein said means for holding includes a sleeve mounted in said mounting means and a shoulder on said crank member for axial engagement with said sleeve.

9. The assembly of claim 7 further including means sealing the openings through said mounting plate.

10. The assembly of claim 9 further including a non-conductive lining over said base plate, said lining having an aperture coincident with each opening through said mounting plate, said aperture being of a size at least equal to the surface area covered by the movement of said mounting means upon rotation of said crank member, a washer member connected to each said mounting means, a gasket member about said mounting means and interposed between said lining and said washer member, and means associated with said attaching means for drawing said washer member toward said mounting plate for sealing engagement of said gasket member with said lining and said washer member.

* * * * *